US006435524B1

(12) United States Patent
Kuncz

(10) Patent No.: US 6,435,524 B1
(45) Date of Patent: Aug. 20, 2002

(54) IN-LINE-ROLLER-SKATE INTERCHANGEABLE INDEPENDENT SUSPENSION, REMOVABLE BOOT AND A CHASSIS SUPPORTING MULTIPLE BRAKE SYSTEMS

(76) Inventor: Ferenc Kuncz, 15464 SW. 114 St., Miami, FL (US) 33196

( * ) Notice: Subject to any disclaimer, the term of this patent is extended or adjusted under 35 U.S.C. 154(b) by 0 days.

(21) Appl. No.: 09/621,832

(22) Filed: Jul. 24, 2000

(51) Int. Cl.[7] ..... A63C 17/04

(52) U.S. Cl. ..... 280/11.221; 280/11.223; 280/11.225; 280/11.231; 280/11.205; 280/11.209; 280/11.211; 280/11.216

(58) Field of Search ..... 280/11.115, 11.19, 280/11.209, 71.205, 11.215, 11.211, 11.208, 11.217, 11.214, 11.213, 11.223, 11.221, 11.216, 11.21, 11.31, 11.206, 11.207; 188/203, 29

(56) References Cited

U.S. PATENT DOCUMENTS 4,298,209 A * 11/1981 Peters ..... 280/11.2
5,280,930 A * 1/1994 Smathers et al. ..... 280/11.2
5,340,131 A * 8/1994 Smathers et al. ..... 280/11.2
5,342,071 A * 8/1994 Soo ..... 280/11.22
5,704,621 A * 1/1998 Lazarevich et al. ..... 280/11.28
5,794,950 A * 8/1998 Svensson et al. ..... 280/11.2
5,823,543 A * 10/1998 Burns et al. ..... 280/11.22
5,895,061 A * 4/1999 Gignoux ..... 280/11.2
6,131,920 A * 10/2000 Roman et al. ..... 280/11.2
6,164,668 A * 12/2000 Majeski ..... 280/11.2
6,227,550 B1 * 5/2001 Maggiolo ..... 280/11.223
6,250,435 B1 * 6/2001 Dellman et al. ..... 188/71.8

* cited by examiner

*Primary Examiner*—Lanna Mai
*Assistant Examiner*—Kelly E Campbell

(57) ABSTRACT

An in-line roller skate in accordance with this present invention includes at least four integral independent suspension system aligned under the chassis platform having all forks axles pivotally in forward motion and opposite direction from each other. The integral independent suspension system all parts and components are integrated in a body-frame, includes at least two independent shock absorber mechanisms in which the front shock absorber suspension mechanisms interconnects with the rear shock absorber secondary mechanisms, in which the rear shock absorber mechanisms support the pivotally forks axles and wheel system. The main chassis system supports the front brake and central rolling-brake. The integral independent suspension and the removable boot systems are interconnected with the chassis system trough a plurality of removable fasteners. The removable boot supports the front and rear anatomical-frame structure and the rear integral independent suspension support the main brake system.

7 Claims, 10 Drawing Sheets

IN-LINE-ROLLER-SKATE INTERCHANGEABLE INDEPENDENT SUSPENSION, REMOVABLE BOOT AND A CHASSIS SUPPORTING MULTIPLE BRAKE SYSTEMS

CROSS-REFERENCES TO RELATED APPLICATION

"Not Applicable"

STATEMENT REGARDING FEDERALLY SPONSORED RESEARCH OR DEVELOPMENT

"Not Applicable"

REFERENCES TO A "MICROFICHE APPENDIX"

"Not Applicable"

BACKGROUND OF THE INVENTION

1.—Field of the Invention 1.a.—This present invention relates to an in-line roller skate integral independent suspension system, and more particularly to such a system which provides a chassis supporting multiple break systems, and a removable boot with four integral independent suspension system with opposite pivotally forks axles which improve the skaters supreme dynamic push-off-force forward and backward free style skating and high performance and stability in all surfaces.

2.—Description of the Related Art 2.a.—In-line roller skates have became very popular in the last years for sports and exercises uses, the in-line skates that actually we know and the problem that represent to skaters due to the unfavorable conditions of roads surfaces are only some of the reasons we present our version of this in-line roller-skate present invention, since, they will be to stimulate and to correct the technical problems and those of performances, also, the current in-line roller skate they don't only represent a problem from road surface conditions due to the designs of complex subduing systems, but they rather present technical problems and physiques for the skaters in general, this above problems and many others we will solve with our in-line roller skate present invention.

2.b.—The original idea of the in-line roller skate it was to imitate the ice skate pattern technology, adding a plurality of tandem wheels and rolling systems and also adding a adjustable articulated boots to obtain ankles mobility to be able to enjoy this touching way of skating on-wheels outside of the winter seasons. In-line skates were created by several in-line wheels with hard boot supporting the ankles area to obtain stability and right wheels control and a precise ride, the wheels in particular were manufactured by soft materials and many types of rolling devices that work very efficiently, also, they were designed aerodynamics styles and interchangeable parts and components in some cases these particular in-line skates uses for sport and competition, recently they added simple or complex shock absorbers devices or called suspension system, also, we found a very different configurations of wheels along the skate like alignment of tandem wheels type (V) and others as well as many experiments with braking control system and wheels in different forms.

2.c.—The fundamental real problem with the conventional in-line roller skates, (V) types roller skates and all others types of roller skates with tandem or blades configuration we denominated, the concept of skating patterns, that means, the differences between those conventional roller skates mentioned above and our in-line roller skate, this concept of skating patterns on wheels are specially related to the in-line rollers skates who support any type of trucks or frame devices and all system mounted on, these doesn't represent the way how you normally, skate like you walk or skating as walking, this concept pattern terminology, we can not applied to any conventional above mentioned roller skate system, since their designs and technologies doesn't allow it because the plurality of wheels are mounted on a fixed frame or structural blade called trucks, also this said truck devices supporting any type of parts and components related to the skates and a plurality of wheels aligned lengthwise and attached to the boot in all combinations, excepting our in-line roller skate presented in this invention having a new design and technology concept of the state-of-the-art, integral independent suspension system all parts and components supported without truck or blade devices, allowing our system to be the nearest in-line-roller skate having a high-performances characteristic likes ice skates, with this all full feature aptitude to skating in one, two, tree or four wheels in all combination possible in forward and rearward motion.

2.d.—The next problem with the conventional in-line roller skates, are the boot system designs and the articulated boot system gives to the ankle certain flexibility forward and backward on short movements and technically divides the boot in two parts otherwise the skater would not be able to move his ankles, this particular articulated ankle design and rigid boot body in ice skates and in ours skates not longer required, we have designed inside the boot a anatomical-frame support and behind this anatomical-frame we support independently the whole front and rear boot structure and both anatomical-frame support the entire fixation from the removable boot system to the chassis system, at the same time the said removable boot system support all attached parts and components. The Followings U.S. Pat. Numbers discloses in brief descriptions many of the backgrounds and acknowledge of each invention.

U.S. Pat. No. 4,298,209, Peters, granted in Nov. 3, 1981, disclose a roller-skate and not disclose a in-line-roller-skate, in this patent matter, Peters doesn't relate to an integral independent suspension system in which all forks axles pivotally in forward motion and opposite direction from each other, removable boot, and chassis supporting multiple brake systems.

U.S. Pat. No. 4,909,523, Olson, granted in Mar. 20, 1990, disclose an in-line-roller skate which includes a lightweight frame and brake of synthetic material reducing vibrations and shock of road bumps, in this patent matter, Olson doesn't relate to an integral independent suspension system in which all forks axles pivotally in forward motion and opposite direction from each other, removable boot, and chassis supporting multiple brake systems.

U.S. Pat. No. 5,280,930, Smathers et al., granted in Jan. 25, 1994, disclose a hydraulic braking mechanisms system for in-line-roller skates, our braking system are mechanically operated and not support or contain any hydraulic conduit device to brake, in this patent matter, Amathers et al., doesn't relate to an integral independent suspension system in which all forks axles pivotally in forward motion and opposite direction from each other, removable boot, and chassis supporting multiple brake systems.

U.S. Pat. No. 5,303,940, Brandner, granted in Apr. 19, 1994, disclose a plurality of angular V type mounted tandem wheels over a plurality of independent trucks or plates which support each angular wheel, in this patent matter, Brandner doesn't relate to an integral independent suspension system in which all forks axles pivotally in forward motion and opposite direction from each other, removable boot, and chassis supporting multiple brake systems.

U.S. Pat. No. 5,340,131, Smathers et al., granted in Aug. 23, 1994, disclose a hydraulic single hand-operated braking actuator system for in-line-roller skates, our braking systems are mechanically and independently operated and not hydraulically and or hand-operated, in this patent mater, Smathers et al., doesn't relate to an integral independent suspension system in which all forks axles pivotally in forward motion and opposite direction from each other, removable boot, and chassis supporting multiple brake systems.

U.S. Pat. No. 5,342,071, Soo, granted in Aug. 30, 1994, disclose an in-line-roller skate, which includes a front and rear pivotable base, a front and rear brake assembly mounted in the front and rear of the bottom of the base, our front brake-device are mounted in the front portion of the skate boot and supported by the chassis and never touch the front wheel to produce a positive wheel stop, the Soo front and rear break assembly touch the front and rear wheel to produce a positive stop, our rear braking system assembly are mounted in a rear body-frame of the suspension and mechanically operated when the rubber base touch the top of the rear wheel or interacts with the central brake rolling devices, Soo system configuration are totally incomparable and incompatible with our braking system, in this patent matter, Soo, doesn't relate to an integral independent suspension system in which all forks axles pivotally in forward motion and opposite direction from each other, removable boot, and chassis supporting multiple brake systems.

U.S. Pat. No. 5,398,949, Tamg, granted in May 19, 1987, discloses a figure-roller blade steering cushion mechanism, as the roller blade skate tilts and also the wheels are aligned on a curved track, this said cushion mechanism will cause the rollers curve to the right or left depend of the body shifting weight, also the brake wheel use the clamping force to brake the skate to stop and this said brake wheel can serve as both wheel and brake at the same time, in this patent matter, Tamg doesn't relate to an integral independent suspension system in which all forks axles pivotally in forward motion and opposite direction from each other, removable boot, and chassis supporting multiple brake systems.

U.S. Pat. No. 5,704,621, Lazarevich et al., granted in Jan. 6, 1998, disclose a suspension system for an in-line-roller skate, in which the suspension system independently controls each wheel of the skate supporting a swing arm and spring mechanisms providing shock absorption with limited mobility pivoting all wheels in one direction only, this particular suspension system is incomparable with our integral independent suspension system, because, our each suspension system are integrated in a body-frame and all forks axles pivoting independently in forward motion and opposite direction from each other, in this patent matter, Lazarevich et al., doesn't relate to an integral independent suspension system in which all forks axles pivotally in forward motion and opposite direction from each other, removable boot, and chassis supporting multiple brake systems.

U.S. Pat. No. 5,794,950, Svensson et al., granted in Aug. 18, 1998, disclose an in-line-roller-skate brake system, our braking system differs completely from this Svensson et al. patent, our in-line-roller-skate not support any boot-frame combination of brake devices, our rear brake system brakes and interacts directly with our rear wheel and not touching the ground surface with any rubber brake device, in this patent matter, Svensson et al., doesn't relate to an integral independent suspension system in which all forks axles pivotally in forward motion and opposite direction from each other, removable boot, and chassis supporting multiple brake systems.

U.S. Pat. No. 5,823,543, Bums, et al., granted in Oct. 20/1998, disclose a roller skate shock absorber system, a truck device including a plurality of in-line wheels, pivot mechanism connecting with truck device and this said truck device support a plurality of parts and components, the truck device support the articulated boot and truck include rear fixed brake, in this patent matter, Bums, et al., doesn't relate to an integral independent suspension system in which all forks axles pivotally in forward motion and opposite direction from each other, removable boot, and chassis supporting multiple brake systems.

U.S. Pat. No. 5,895,061, Gignoux, granted in Apr. 20, 1999, disclose an in-line-roller skate comprising a chassis equipped with rollers, and a removable articulated boot equipped with a brake device and a boot lever mechanisms to release the boot from the wheeled chassis, our removable boot system remove the boot only without removing part of the brake system, our boot body-structure not support articulated boot partition like others conventional in-line-rollers skates, and our braking system are independent from the boot, our chassis system supports independently the removable boot and multiple braking systems, the Gignoux in-line-roller-skate differs from our present invention, because the chassis, wheels and brake system are together and not independent, in this patent matter, Gignoux, doesn't relate to an integral independent suspension system in which all forks axles pivotally in forward motion and opposite direction from each other, removable boot, and chassis supporting multiple brake systems.

U.S. Pat. No. 5,961,131, Hilgarth, granted in Oct. 5, 1999, disclose a roller skate shock absorber device comprising an elastic foil element, interconnected between the boot floor and a fixed truck device supporting the plurality of wheels parts and components, in this patent matter, Hilgarth doesn't relate to an integral independent suspension system in which all forks axles pivotally in forward motion and opposite direction from each other, removable boot, and chassis supporting multiple brake systems.

U.S. Pat. No. 5,975,542, Kaufman, granted in Nov. 2, 1999, disclose a hanger for roller skate having shock absorber characteristic in vertical and horizontal planes utilization on the frame of roller skate, in this patent matter, Kaufman doesn't relate to an integral independent suspension system in which all forks axles pivotally in forward motion and opposite direction from each other, removable boot, and chassis supporting multiple brake systems.

U.S. Pat. No. 6,012,725, Mitchell, et al., granted in Jan. 11, 2000, disclose a roller skate systems and methods for slowing or stopping a plurality of roller skate wheels attached a truck or frame device include articulated boot supporting all parts and components, in this patent matter, Mitchell, et al., doesn't relate to an integral independent suspension system in which all forks axles pivotally in forward motion and opposite direction from each other, removable boot, and chassis supporting multiple brake systems.

U.S. Pat. No. 6,012,727, Chang, granted in Jan. 11, 2000, disclose a vibration absorber assembly for the wheel seat of a roller skate, including a shoe, a plurality of vibration absorbers, multiple bolts and rollers, attached to boot bottom and truck or frame device supporting all parts and components, in this patent matter, Chang doesn't relate to an integral independent suspension system in which all forks axles pivotally in forward motion and opposite direction from each other, removable boot, and chassis supporting multiple brake systems.

U.S. Pat. No. 6,015,156, Pratt, granted in Jan. 18, 2000, disclose an in-line skate detachable boot system having a wheeled chassis and a detachable boot for walking the chassis has a elongated frame an a plurality of wheels mounted to the frame, the bottom of the boot support the frame and a plurality of wheels parts and components, in this patent matter, Pratt doesn't U.S. Pat. No. 6,015,157, Hilgarth, granted in Jan. 18, 2000, disclose a roller skate adaptable to user, style, and terrain, comprising the body of the shoe wherein the skater's foot and part of the leg are housed, the boot support the skating elements and the frame supports the elements parts and components with a plurality of wheels, in this patent matter, Hilgarth doesn't relate to an integral independent suspension system in which all forks axles pivotally in forward motion and opposite direction from each other, removable boot, and chassis supporting multiple brake systems.

U.S. Pat. No. 6,017,041, Gignoux, granted in Jan. 25, 2000, disclose an in-line roller skate which a main chassis having to lateral plates between which at least to rollers are mounted, and an auxiliary chassis which is U-shape profile, which straddles the main chassis and is articulated onto this said main chassis, the object makes it possible to free the interior of the main chassis for the rollers, in this paten matter, Gignoux doesn't relate to an integral independent suspension system in which all forks axles pivotally in forward motion and opposite direction from each other, removable boot, and chassis supporting multiple brake systems.

U.S. Pat. No. 6,019,377, Chiu, et al., granted in Feb. 1, 2000, disclose a skate having an easily assembling structure, includes a boot having a rod, a frame and a lock device which includes a hook and a spring devices parts and components, the object is engage and disengage the frame from the boot, in this patent matter, Chiu, et al., doesn't relate to an integral independent suspension system in which all forks axles pivotally in forward motion and opposite direction from each other, removable boot, and chassis supporting multiple brake systems.

U.S. Pat. No. 6,019,379, DeMarchi, granted in Feb. 1, 2000, disclose an in-line roller skate having a breaking mechanism device including a boot associated with and upper plate of frame on which the skating wheels are arranged, in this patent matter, DeMarchi doesn't relate to an integral independent suspension system in which all forks axles pivotally in forward motion and opposite direction from each other, removable boot, and chassis supporting multiple brake systems.

U.S. Pat. No. 6,039,329, Bums, et al., granted in Mar. 21, 2000, disclose an roller skate shock absorber system, a suspension system for a skate including a shoe and truck device with a plurality of wheels, in this patent matter, Burns, et, al., doesn't relate U.S. Pat. No. 6,045,142, Andrich, granted in Apr. 4, 2000, discloses an in-line roller skate converted to skating in all terrain attaching brackets which carry large wheels and a suspension system, in this patent matter, Andrich doesn't relate to an integral independent suspension system in which all forks axles pivotally in forward motion and opposite direction from each other, removable boot, and chassis supporting multiple brake systems.

U.S. Pat. No. 6,131,920, Roman et al., granted in Oct. 17, 2000, disclosure a braking control device for skates, which interacts with the articulated portion of the boot and the rear portion of the chassis, in this patent matter, Roman et al. doesn't relate to an integral independent suspension system in which all forks axles pivotally in forward motion and opposite direction from each other, removable boot, and chassis supporting multiple brake systems.

U.S. Pat. No. 6,164,668, Majestic, granted in Dec. 26, 2000, disclose a Hydraulic brake system for in-line-roller skate application, our braking system operate without any type of hydraulic mechanisms, in this patent matter, Majestic doesn't relate to an integral independent suspension system in which all forks axles pivotally in forward motion and opposite direction from each other, removable boot, and chassis supporting multiple brake systems.

U.S. Pat. No. 6,227,550 B1, Maggiolo, granted in May 8, 2001, disclose a structure to support or improve maneuverability and control over in-line-skates wheels, in this patent matter, maggiolo doesn't relate to an integral independent suspension system in which all forks axles pivotally in forward motion and opposite direction from each other, removable boot, and chassis supporting multiple brake systems.

U.S. Pat. No. 6,250,435 B1, Dellmann et al., granted in Jun. 26, 2001, disclose a actuation device for machine elements having wear-induced play, this particular machine elements not are comparable and compatible with our suspension system elements and functionality's characteristics, in this patent matter, Dellmann et al., doesn't relate to an integral independent suspension system in which all forks axles pivotally in forward motion and opposite direction from each other, removable boot, and chassis supporting multiple brake systems.

SUMMARY OF THE INVENTION

This particular in-line-roller skate in accordance with this present invention, includes four integral independent suspension, a removable boot, and a chassis supporting the multiple brake systems, all parts and components according with this present invention. The removable boot anatomical-frame structure support said front and rear portion boot structure means the front and rear section of the boot incorporate an anatomical-frame support, which interconnects the boot platform to main-chassis trough a plurality of removable fasteners, the boot rear anatomical-frame support means attach the rear portion of the chassis to the central portion of the rear anatomic-frame, the superior anatomic-frame having an extension circular-band means supporting shoe structure, the top portion of the boot having a plurality of braids devices.

The removable boot anatomical-frame structure support means build-in the boot complex, the boot is removable through the attachment fasteners elements and fixed inside under boot-platform said fasteners are screwed to the top surface of the chassis.

According with this present invention the central front part of the chassis support the front brake system, the chassis rear portion support the integral suspension means master-brake system attached to the front suspension portion body-frame, the central rolling-brake means attached to the central portion chassis bottom resilient extension.

The four integral independent suspension system means suspension complex incorporate a plurality of pivotable fork axles, all suspension system operate mechanically independent from each other, front and rear suspension complex means all forks axles pivotally in forward motion and opposite directions from each other.

The main-brake system supported by the front portion of the suspension body-frame means rear suspension complex support said pivotable main-brake forks axles, said forks axles supporting a pre-loaded coils spring, said main-brake system supporting forks axles parallelly aligned with the rear portion of the chassis platform, said rear portion forks supporting a upper rubber pad, said lower portion forks having a second rubber pad, said upper rubber-brake main-brake incorporate in the upper portion of the forks a plurality of minor rubber pad, The said secondary suspension shaft chamber means shock absorber suspension rear axle torsional coils spring supporting rear shaft and said spring retaining collars, said middle rear axle shaft means support central head-trigger and ball bearings devices and interconnects said primary shock absorber shaft end means pivot axles mechanisms and said pivot axles main-ball bearings support, said pivot axles support adjustable manually knob and said pivot axles cover.

This particular in-line-roller-skate support four integral independent suspension system means said main-shock absorber chamber assembly having hydraulic fluid primary reservoir chamber said hydraulic fluid chamber means main-shaft having around shock compression coils spring, main shaft attached to shock piston, said shocks piston front side attached said adjuster knob, shock absorber chamber rear assembly support shaft seal-guide said middle shaft front portion pivot axle interconnect with said rear shaft portion of the front shock absorber and the rear part of said middle shaft pivot axle interconnect with the front head trigger mechanisms and said ball bearings devices.

The front suspension system detailing a double hydraulic-fluid-flow second reservoir Chamber said secondary chambers supporting said front shock absorber hydraulic-fluid-flow damper control valve. All parts and mechanical components build in accordance with the present invention.

It is therefore our principal object of this invention to provide an in-line-roller skate integral independent suspension system compatible and adjustable to all skaters styles and requirements without limits, reducing physically stress of skaters and improving general performances and high stability and control over all terrain and surfaces.

It is further object of this invention to provide an in-line-roller skate integral independent suspension, removable boot, and chassis supporting multiple brake systems.

It is further object of this invention to provide an in-line-roller skate removable boot system with anatomical front and rear base-plate supporting the ankle stability without the articulated and rigid conventional in-line-roller skate boot characteristic system.

It is another object of this invention to provide an in-line-roller skate a reliable front and rear brake multiple system, improving skating forward and backward brake capability.

It is another object of this invention to provide an in-line-roller skate a central rolling-brake system, having with the brake rolling devices to improve extreme skating conditions interacting with the main brake system.

It is another object of this invention to provide an in-line-roller skate chassis, having integral structure and supporting at the same time all parts and components.

These and others objects, features and advantages of this invention will be apparent after reading the detailed descriptions of the structure and arrangement of the preferred embodiments thereof in reference to the appended drawings and text.

BRIEF DESCRIPTION OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
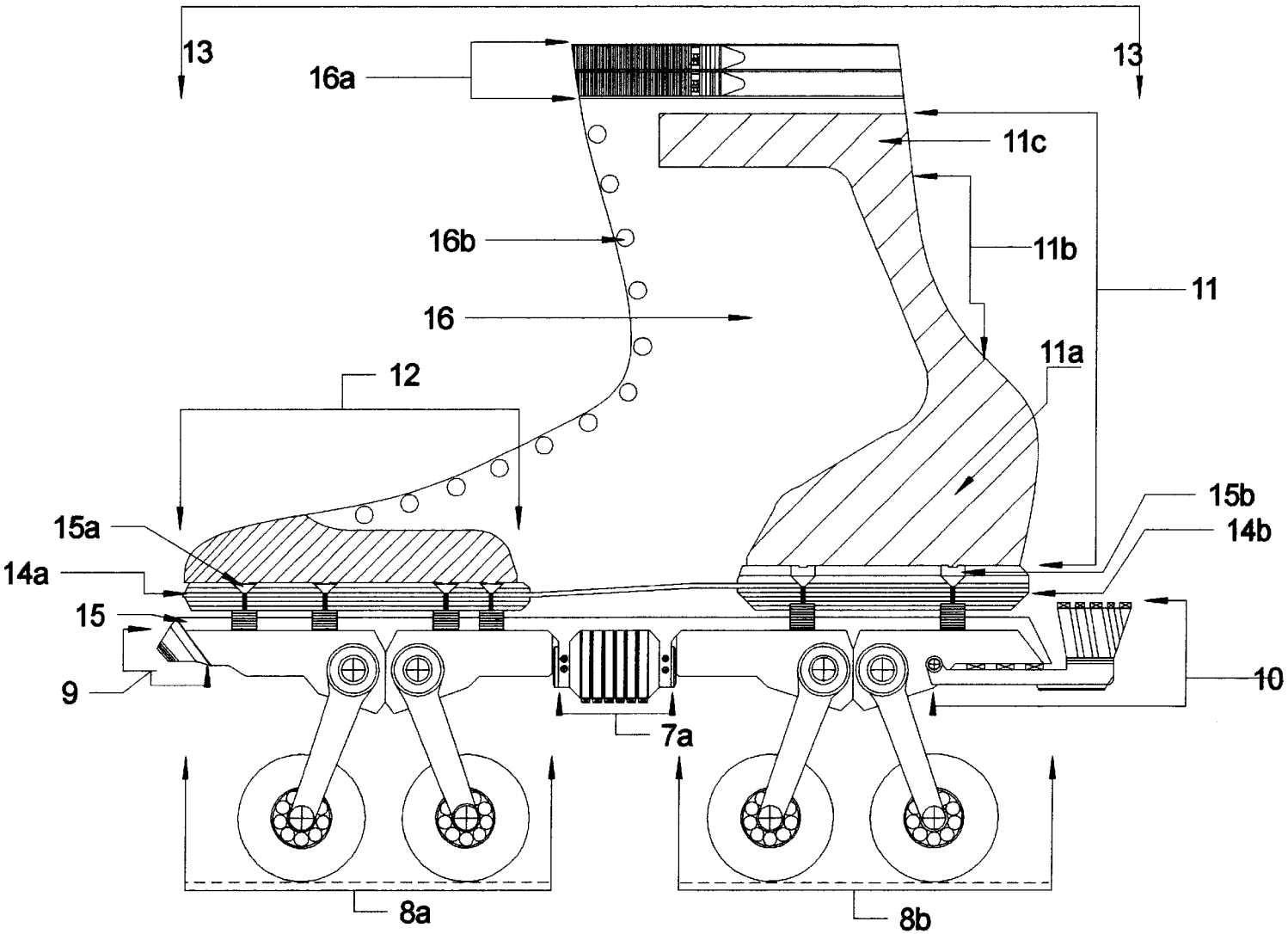
FIG. 1 is a side elevation view of the preferred embodiment of an in-line-roller skate detailing four integral independent suspension systems, the removable boot, and a chassis supporting multiple brake systems all constructed in accordance with the present invention.

Referring to FIG. 1 is a side elevation full view of the preferred embodiment, represents the general assembly, and details all parts, components and constructions of this present invention 13. The in-line-roller skate 13 includes a chassis 15 longitudinally aligned under the boot 16, and supporting the removable boot 16, the chassis 15 support the front brake assembly 9, and the central rolling-brake assembly 7*a*, the front 8*a* and rear 8*b* complex assembly of the four integral independent suspension system.

Shoe assembly 16, which includes front anatomical-frame 12, which support the front portion of the shoe anatomic-frame 14*a*, and simultaneously attach the anatomic-frame 14*a* and support the full boot 13 to the front section of the chassis 15, the rear anatomical-frame ankle support 11, the additional multi-function of the ankle support bar 11 it's to control and support the ankle articulation in a rigidly positions related to the wheels and increasing the overall skater stability over all surface, however, the central part of the said anatomic-frame support 11*b* are flexible, the superior portion 11*c* the front top portion of the boot 16 also include a plurality of braids adjustment 16*b* from the low part of boot 16 until the boot pressure adjusters devices 16*a*, the attachment of the bottom front portion of the removable boot 16 trough the chassis system 15 with the front anatomic-frame support 12 are screwed with a plurality of removable embedded fasteners 15*a*, among the base of the front anatomical support 12 and the base of the floor front boot 14*a*, the attachment of the bottom rear portion to the removable boot 16 against the chassis 15 with the rear anatomic support bar 11 are screwed with a plurality of removable embedded fasteners 15*b* among the base of the back anatomical support 11*a* and the base of the rear boot platform 14*b*.

The boot ankle anatomical-frame structural support 11 and the boot toes anatomical-frame structural support 12 build-in inside the boot structure 16, the removable boot system 16 through the fasteners 15*a* and 15*b*, these fasteners 15*a* and 15*b* are fixed inside the boot platform 14*a* and 14*b* also these fastener 11*a* and 15*b* are screwed to the top surface of the chassis 15.

The front part of the chassis 15 support the front brake assembly 9, the central portion of the chassis 15 support the central rolling-brake system 7*a*, and interacts directly with the master brake assembly 10, the multi-break-action mechanical master brake 10, is attached to the back side of the body-frame rear suspension 8*b*.

Figure 2:
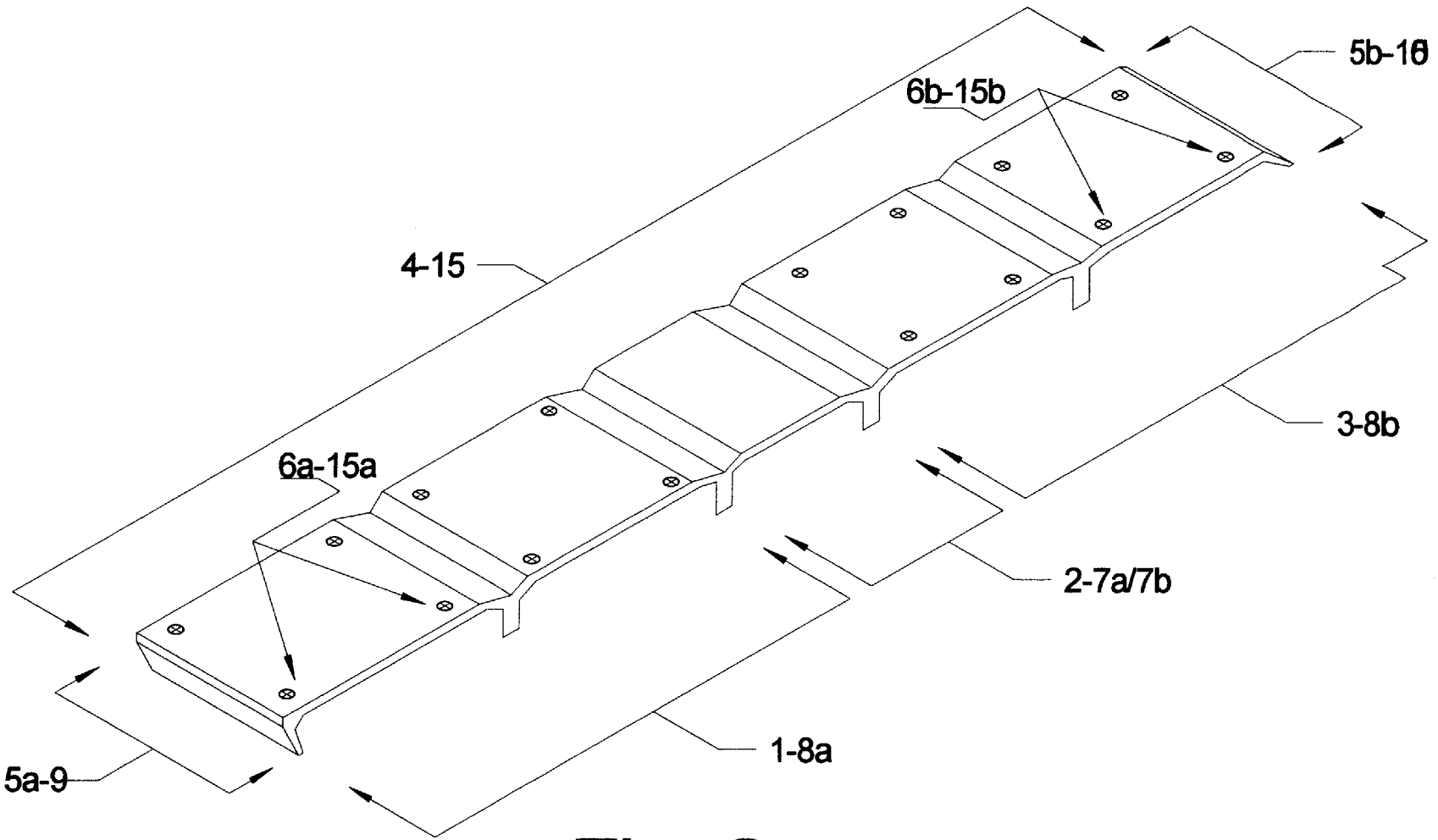
FIG. 2 is an isometric view of a longitudinal symmetrical partitions of the chassis that support all parts and components of the present invention.

Referring to FIG. 2, is an isometric view of an chassis assembly 4–15, support all parts and components of this present invention, the chassis assembly 4–15 is longitudinally installed under the central portion of the platform of boot 14*a* and 14*b* (show in FIGS. 1-14*a*–14*b*) and is attached to the removable boot system 16 (show in FIGS. 1-16) through removable front fasteners 6*a*–15*a* and removable rear fasteners 6*b*–15*b* (show in FIGS. 1-15*a*–15*b*, the chassis 4–15 front bottom section support the front independent suspension assembly 1–8*a* (show in FIGS. 1-8*a*), the middle section of the said chassis 4–15 support the central removable rolling-brake system 2–7*a* and 2–7*b* (show in FIGS. 1-7*a*–7*b*), the front bottom portion of the chassis 4–15 support the front brake assembly 5*a*–9 (show in FIGS. 1-9) and the rear section of the said chassis 4–15 interacts the master-rear-brake system 5*b*–10 (show in FIGS. 1-10).

Figure 3:
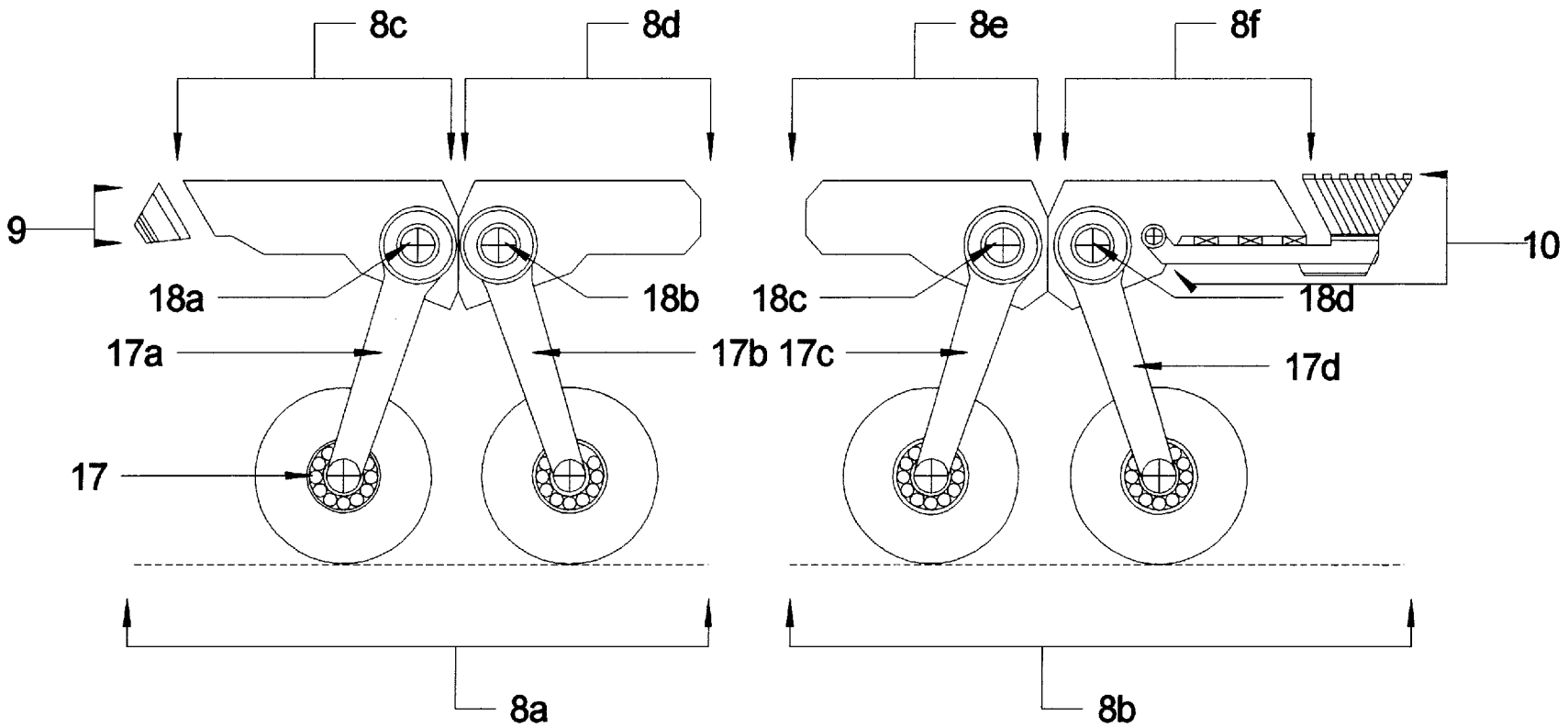
FIG. 3 is a side elevation view of all front and rear independent suspension system configurations, detailing front and rear brakes system with respective axles, forks, and wheels all parts and components.

Referring to FIG. 3, is a side elevation view of the front 8*a* and rear 8*b* integral independent suspension system assembly, the front section 8*c* of the front independent suspension 8*a*, incorporate the pivotable axle 18*a* and support the forks portion 17*a* and the wheels system 17, the referred front section independent suspension assembly 8*c* and rear independent suspension section assembly 8*d*are mechanically independent from 8*c*, 8*d*, 8*e*, 8*f*, and all axles 18*a*–18*b* and 18*c*–18*d* pivoting in forward motion and opposite direction from each other, and the rear suspension system 8*f* support the main rear-brake system 10.

Figure 4:
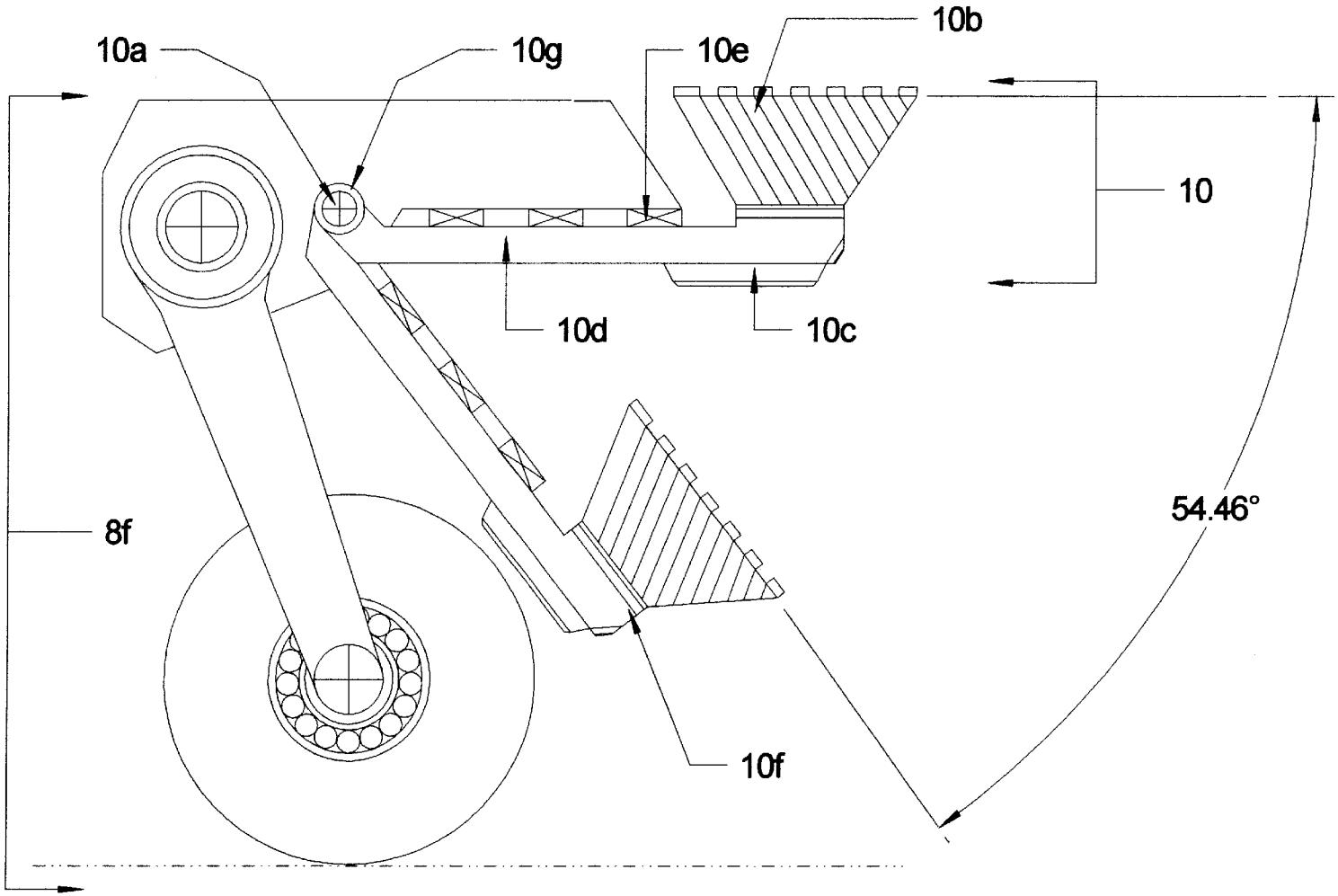
FIG. 4 is a side elevation view of a rear suspension system, detailing the rear brake characteristic, dynamic functions, performances with all parts and components.

Referring to FIG. 4, is a side elevation view of the main-brake system attached to the rear central mid-portion of the independent suspension system 8*f*, detailing the central main-brake system assembly 10, the main-brake system 10 supported by the rear independent suspension system 8*f* and attached to the rear mid-portion of the independent suspension body-frame, through the pivotable axle 10*a*, which support a torsional coil spring suspension 10*g* supporting the up and down pressure force of the brake forks 10*d* and all main-brake system assembly 10, the main-brake system incorporate a pair of forks 10*d* and the rear top portion of the forks 10*d* support the attached upper-rubber-platform 10*b*, and the lower part of the fork 10*d* support a hard-rubber-composition 10*c*, the upper brake rubber-platform 10*b* interacts with the central brake 7*a* (not showed in this FIG. 4) and stop the rear wheel speed, the main-brake system 10 incorporate in the upper side of the forks 10*d* a plurality of minor hard-rubber-tops 10*e* to slow or absorb the return impacts from the forks 10*d* and returned those to his original position, the skaters have many multiple choices how to use this main-brake system 10, in other words, when the skater applying down-pressure with the boot toward to the rear-wheel axle and keeping the main-brake system 10 in original position, the skater choice a frictional ground contact with the lower part of the brake rubber portion 10*c*, this FIGS. 4-10*f* shows the dynamic part of this main-brake system 10, and the pivoting axle 10*a* opening angle capacity which is approximate 0 to 55 degree.

Figure 5:
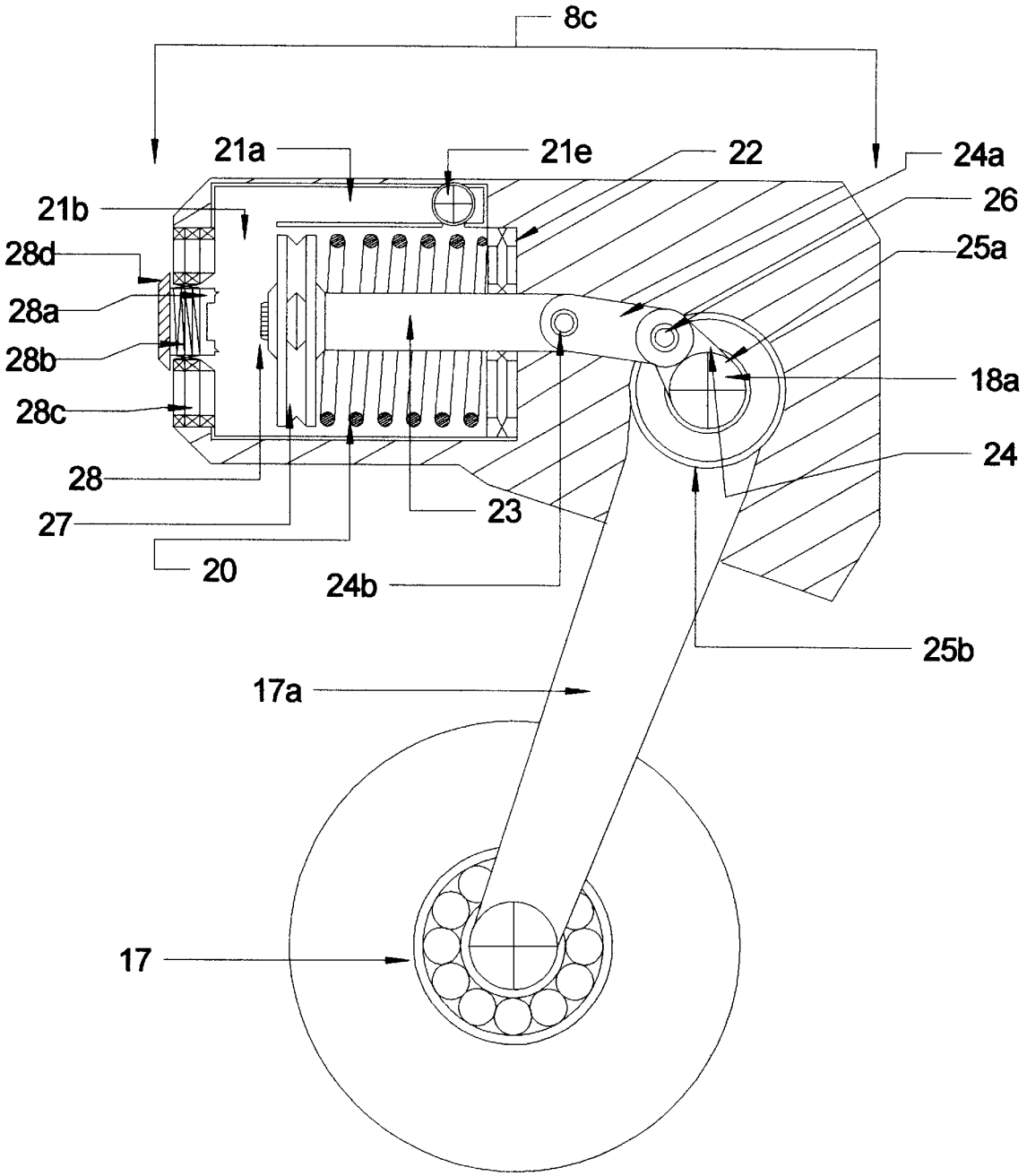
FIG. 5 is a side elevation in cross sectional view one of the independent suspension system, detailing the front section of the shock absorber chamber all parts and components which is constructed in accordance with the present invention.

Referring to FIG. 5, is a side elevation in cross-sectional view of the front section of the integral independent suspension system 8*c* detailing the front shock absorber chamber assembly section 21*b* and all parts and components of this present invention, the assembly section 21*b* contain the hydraulic fluid reservoir, this said hydraulic fluid chamber 21*b* support the main shaft 23 around the main shaft 23 a shock absorber coil spring 20 take place, and the end part of the said main shaft 23 is attached the shock absorber piston 27, the shock absorber piston 27 front side is attached to a adjuster knob 28, this said adjuster knob 28 adjust the pressure or compression of the shock absorber coil spring 20, the shock absorber chamber 21*b* rear assembly is supported trough is shaft guide 22 also control the pressure and seal the main shaft 23, the main shaft 23 is interconnected with the middle shaft extension 24*a* front part trough a middle pivoting axle 24*b* and the rear part of this said middle shaft 24*a* is attached and connected to the rear pivot head central trigger 24 trough a rear middle pivoting axle 26.

The front section 8*c* support the pivoting axle 18*a* this said pivot axle 18*a* support a adjuster knob 25*a* and adjust the coils springs pressure inside the pivoting axle chamber 18*a* and adjuster knob 25*a* pressure screw 25*b*, this said pivoting axle 18*a* is supported with is diagonal aligned forks 17*a* and is rolling system 17.

The front section 8*c* detailing a dual hydraulic fluid second reservoir chamber 21*a*, this said dual extension side chambers 21*a* supporting the hydraulic fluid flow damper control valve 21*e*, this said front section 8*c* details the front piston top brake control pad 28*c* and detailing the rubber brake pad 28*a* attached to the removable screw 28*b* and screw cover device 28*d*.

Figure 6:
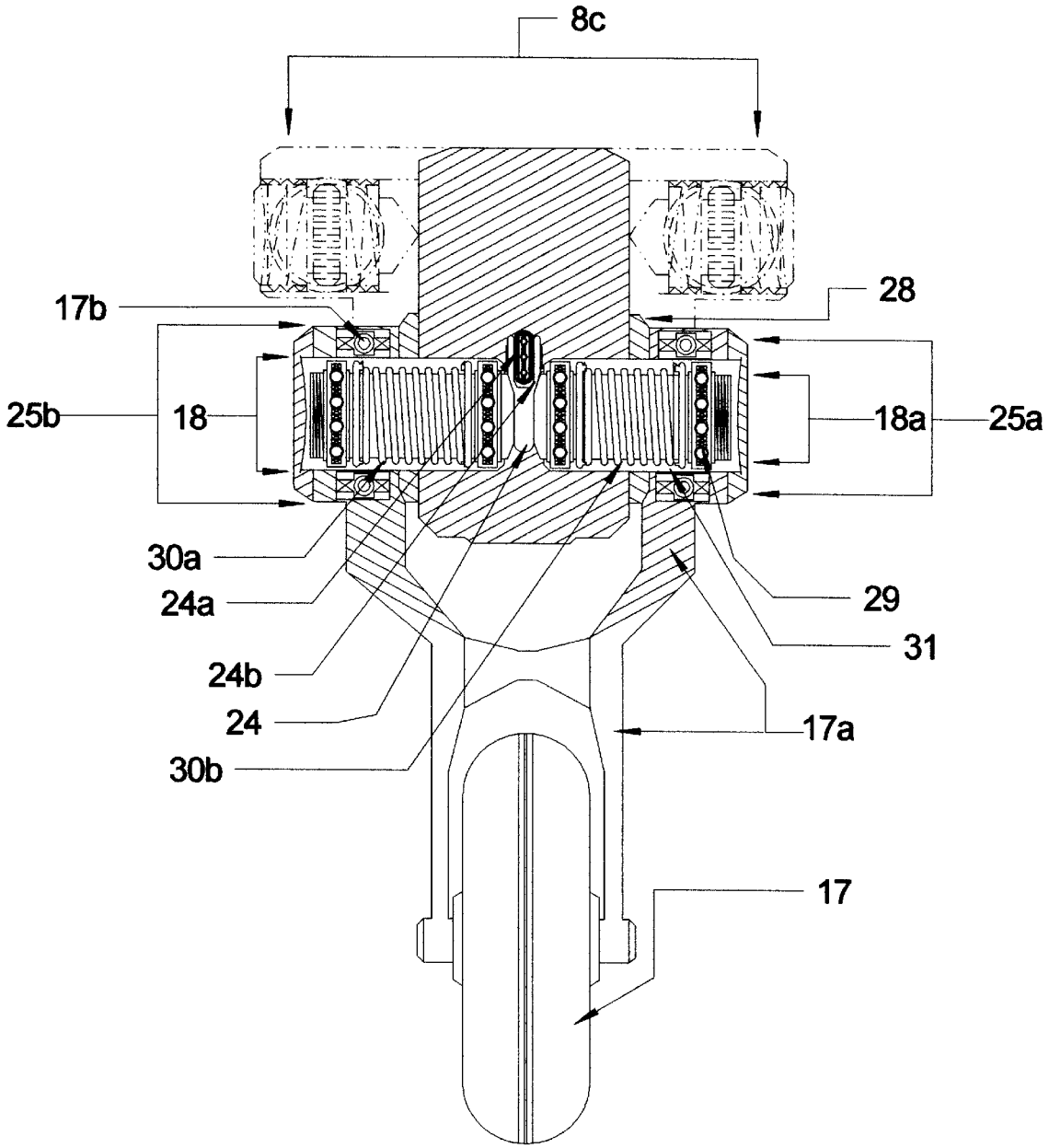
FIG. 6 is a rear elevation in cross sectional view of the backside chamber section of the one of the independent suspension system, detailing the rear axle shaft, the double torsional suspension coils springs, the plurality of ball bearings systems all parts and components.

Referring to FIG. 6, is a rear elevation in cross sectional view of the backside assembling of the integral suspension system 8*c* detailing rear axle suspension system chamber 18 torsional double coils springs 30*b* and a plurality ball bearings rolling devices 29 and all parts and components.

The particularity of this FIG. 6 rear portion of the integral independent suspension system 8*c* is to support a constant down-force pressure over the pivoting axle 18*a*, and keeping the forks 17*a* and the wheels 17 in ground lively or down position, the rear axle torsional springs coils 30*b* is supported trough a main rear shaft 30*a* and a spring retaining collar 31, the other particular rear portion of the integral independent suspension system 8*c* means the capability to adjusting the shock absorber spring coils pressure trough his adjuster knob 25*a*, supporting and sharing the total lift weight-up-force capacity interacting with the main shock absorber, the middle part of the said rear axle shaft 30*a* support the central head trigger 24 and rolling devices over a rear axle ball-bearings pivot 26 (show in FIGS. 5-26) the forks eyelets 28 and the forks pressure screw covers 25*b* and the forks axle main rolling device 17*b*.

Figure 7:
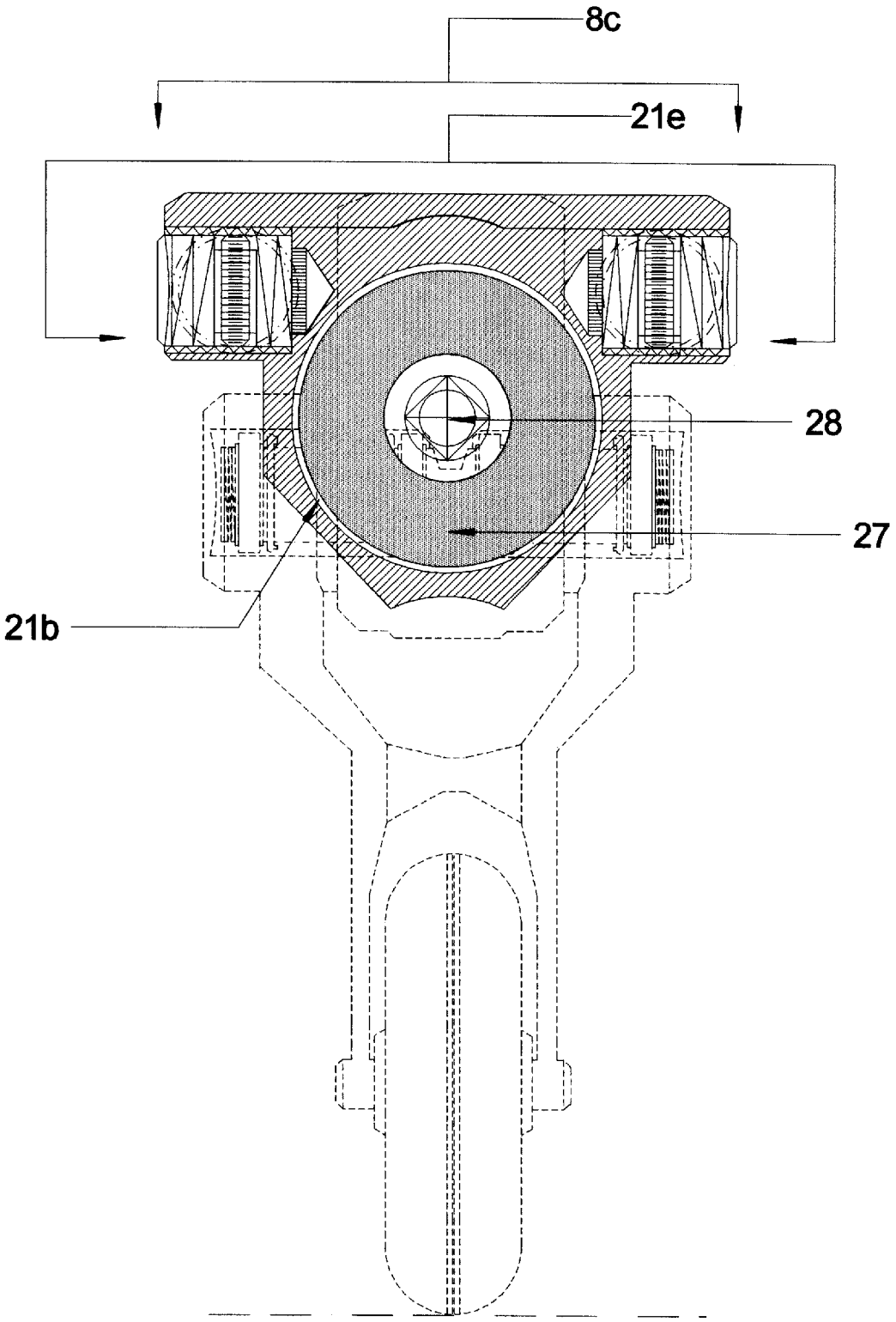
FIG. 7 is a front elevation in cross sectional view of one of the front independent suspension shock absorber chamber, detailing the front portion of the shock-piston and shaft chamber with front adjustable spring piston bolt and hydraulic fluid by-pass damping screw adjuster, all parts and components.

Referring to FIG. 7, is a front elevation in cross sectional view of the front section of the integral independent suspension system assembly 8*c*, detailing the front view of the shock absorber chamber 21*b* front shock piston 27 and a view of the front adjuster knob 28 with hydraulic fluid flow damper control valves 21*e*.

Figure 8:
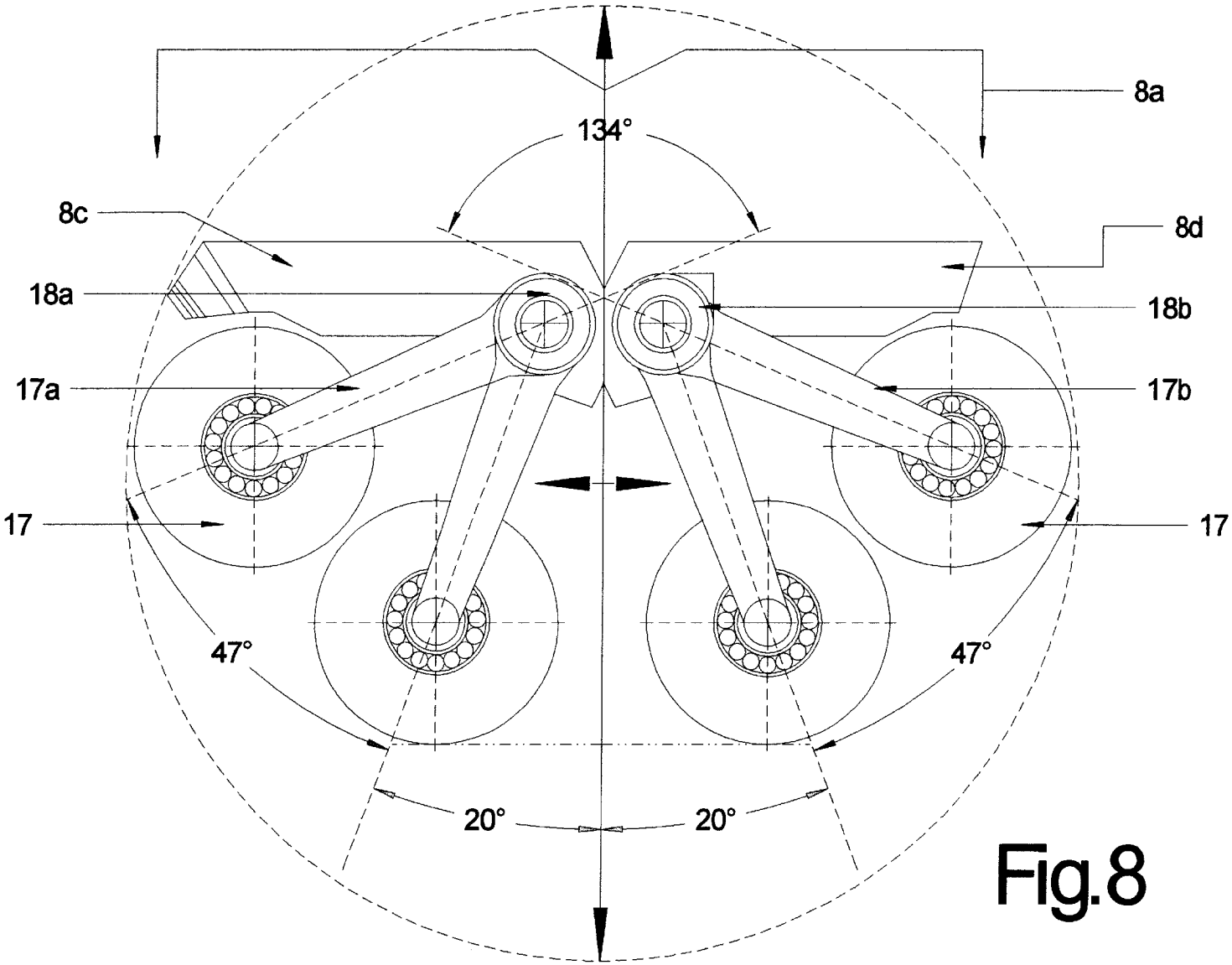
FIG. 8 illustrate a side elevation schematic diagram view from one of the independent suspension system complex, detailing all the ranges and opening angles of the suspension, showing the suspension dynamic function and performance with all parts and components.

Referring to FIG. 8, this particular section illustrate a side elevation schematic diagrams view of the front complex integral independent suspension system 8*a*, detailing the front pivotable axle assembly of the integral independent suspension 8*c* and the front opposite side of the integral independent suspension 8*d* showing the general dynamics performance's view of the both integral independent suspension pivots axles capabilities 18*a*–18*b*.

The other particular FIG. 8, illustration front pivotable axle 18*a* and front opposite pivotable axle 18*b* general dynamics performances of the unique integral independent suspension system with opposite push-off-force suspension characteristics, this particular high-technology is one of the most relevant innovation on our present in-line-roller-skate invention, and also the absence of truck-frame-blade devices who support partially or totally the wheels systems in all traditionally in-line -roller skate with or without springs-shock absorber systems.

The front pivotable axle 18*a* and front opposite pivotable axle 18*b* opening angle will be 0°/47° approximately between closed wheels 17 in down position and springs coils in extension position, and open wheels 17 in up position and springs coils in compression position, all depends how large or small will be the wheels diameter choices by the skaters 17, the total opening ranges from the integral independent suspension system pivotable axles 8*a* will be between 40° and 140° approximately, and including the forks 17*a* and 17*b*.

Figure 9:
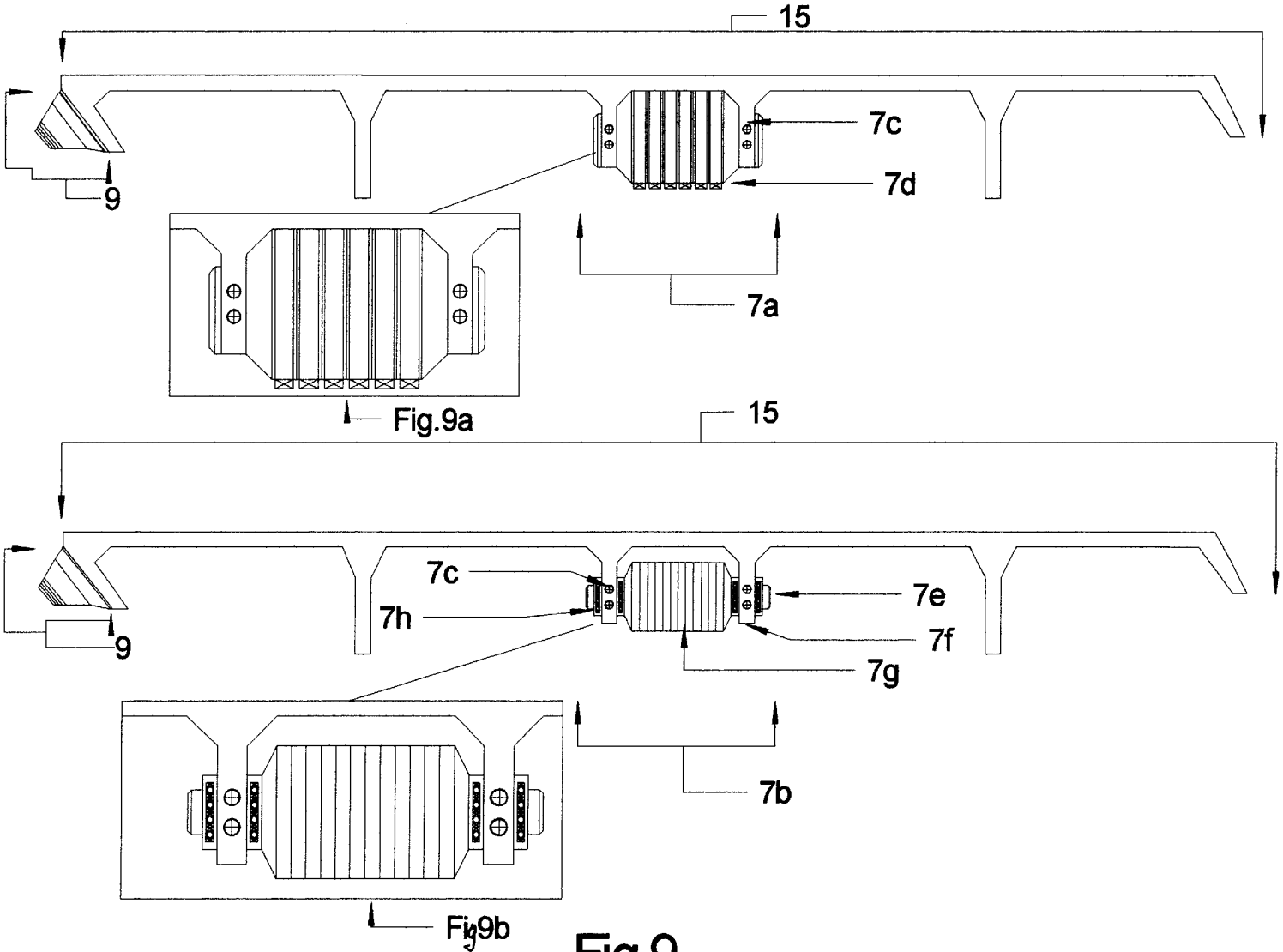
FIG. 9 illustrate a side elevation view of a longitudinal chassis, detailing the interchangeable combinations of the central rolling-brake assembly, and the front chassis brake assembly systems with all parts and components.

Referring to FIG. 9 and close-view FIGS. 9*a*–9*b*, this particular sectional side elevation view the chassis 15, detailing the interchangeable central rolling-brake 7*b* and central-brake 7*a* assembly all parts and components, this central rolling-brakes 7*b* and central-brake 7*a*, interacts directly with the main-brake system device FIG. 4 section 10, this relevant part of this central rolling-brake's system 7*a* and 7*b* it's to provide high breaking flexibility an stability in all extreme conditions.

The FIG. 9*b*, details the close-view of the optional central rolling-brake assembly 7*b*, and central rolling-brake 7*b* support ball-bearings devices 7*h*, the central rolling-brake his covered with hard-rubber compound 7*g* and attached to the exterior portion of the body-rolling-brake 7*b*, the central rolling-brake's system 7*a* and 7*b* includes a plurality of quick removable fasteners 7*c* attached the chassis central extension support 7*f*. The central rolling-brake system incorporate the axle 7*e*, the chassis 15 disclose the front brake device 9, assembly.

The FIG. 9*a*, represents the close-view of the standard central-brake assembly 7*a*, this central-brake assembly 7*b* not support rolling devices likes disclosure in FIG. 9*b*, and support a fixed hard-rubber compound 7*d* attached to the exterior side of the body-brake 7*a* and interacts with the main-brake system.

Figure 10:
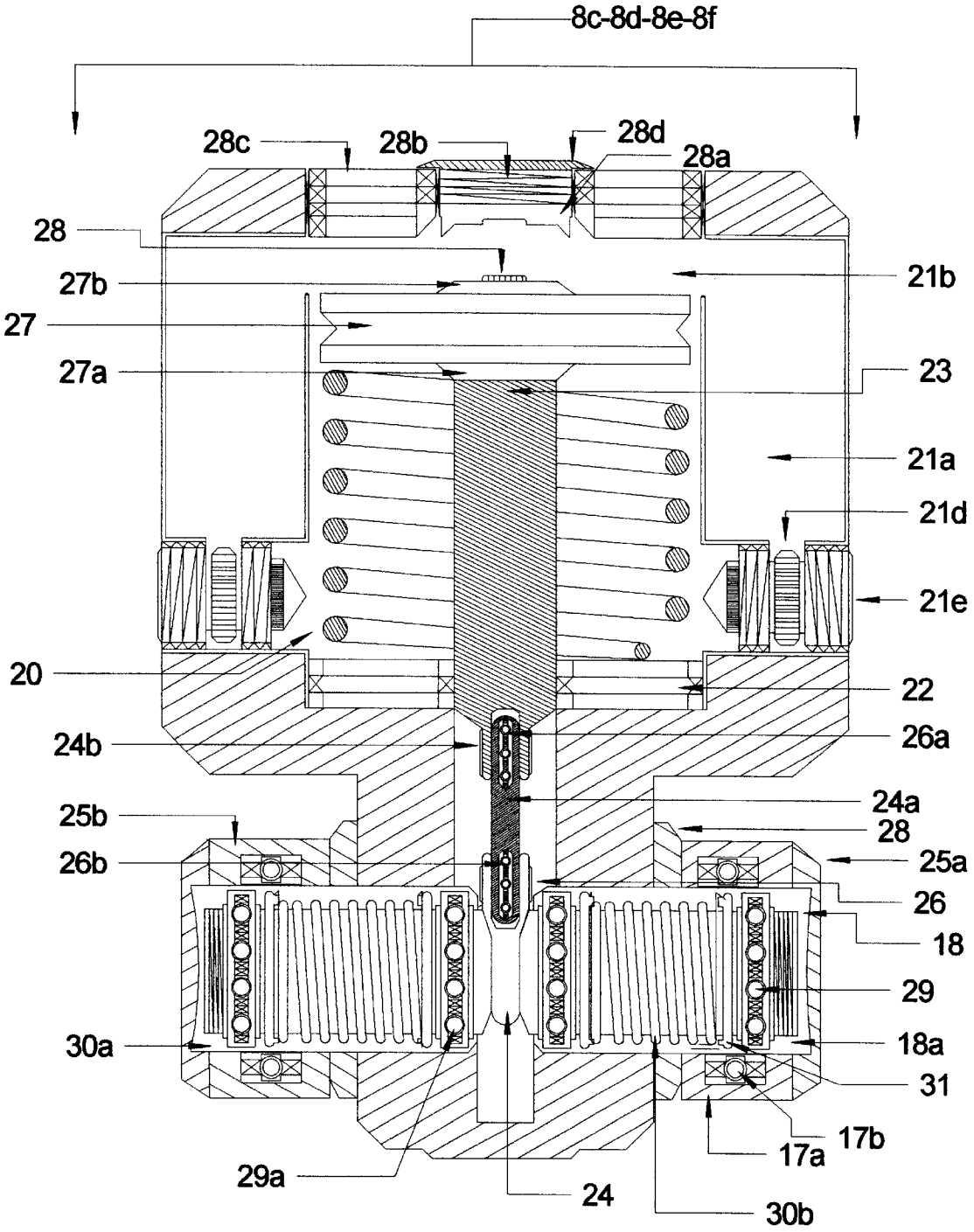
FIG. 10 illustrate a top cross sectional view of the in-line-roller-skate integral independent suspension systems, detailing the shock absorber front and rear chambers assemblies with all parts and components.

Referring to FIG. 10, detailing the full top cross-sectional view of the in-line-roller-Skate integral independent suspension systems, all parts and components constructed in accordance with the present invention.

The integral independent suspension system assembly, detailing the shock absorber front portion chamber assembly section 21*b* containing the hydraulic fluid primary reservoir chamber 21*b*, this said hydraulic fluid chamber 21*b* support the shock absorber main shaft 23, around the shock absorber main shaft 23 a shock absorber compression coil spring 20 take place, the front part of the said shock absorber main shaft 23 is attached the shock absorber piston 27, the said shock absorber piston 27 front side is attached to a manually adjustable knob 28, this said adjustable knob 28 regulate the compression and extension pressure of the shock absorber coil springs 20 trough the front 27*b* and rear adjustable thread collars 27*a*, the said shock absorber chamber 21*b* rear assembly support the shaft seal guide 22, also this particular shaft seal guide assembly 22 control and seal the shock absorber main shaft 23.

This said middle shaft 24*a* interconnects with the rear end portion of the shock absorber shaft 23 and the front portion of the central trigger head 24, the middle shaft 24*a* front portion interconnects with the shock absorber main shaft end portion 23 trough the front pivot axle 24*b*, and the said front pivot axle 24*b* support a ball bearing devices 26*a*, the middle shaft rear portion 24*a* interconnects with the front portion of the central trigger head 24 trough the rear pivot axle 26, and the rear pivot axle 26 support a ball bearing devices 26*b*.

The integral independent suspension system assembly, detailing a lateral double hydraulic fluid second reservoir chamber 21*a*, this said chamber 21*a* support the shock absorber (extension and compression pressure function) hydraulic fluid flow damper control valve 21*e*, the most relevant characteristic of this said damper control valve 21*e*, is to interact directly with the main piston head 27 and control the shock absorber damper speed hydraulic high-fluid-flow pressure, this said high-fluid-flow valve control 21*e* support the 21*d* hydraulic high-fluid-flow by-pass device screw adjustable system.

The integral independent suspension system assembly, support the external portion of the pivot axles 18*a*, the external portion of the said pivot axles 18*a* support a manually adjustable knob device 25*a* and the ball bearings device 17*b*, also control and adjust the pressure of the torsional coils spring 30*b* and 30*c* inside the pivot axle chamber 18*a*, this said pivot axles 18*a* support the forks 17*a* and wheels systems The backside assembly of the integral independent suspension system, detailing the rear shock absorber shaft chamber 18, the right torsional coils spring 30*b* and the left torsional coils spring 30*c*, the shock absorber shaft support a plurality of ball bearings 29 and 29*a*, the rear axle springs coils 30*b* support trough a main rear shaft 30*a* a spring retainer collar 31, and a forks base-cover device 28*a*, the particularity of this said backside suspension coils spring system 30*b*, is to supports, share and control the gross lift weight push-off-force suspension capacity with the main or front shock absorber system. The said integral independent suspension system, details the front piston top brake control support pad 28*c* and detailing the central rubber brake pad 28*a* attached into the removable screw 28*b* and said screw cover device 28*d*.

What is claimed is:

1. An In-line-roller skate having four in-line wheels with four integral independent suspension systems, a removable boot, and a chassis structure supporting multiple brake systems, comprising:

(a) a chassis system supporting and interconnecting at least four integral independent suspension systems mounted directly under the chassis structure;

a front structure of the chassis supporting a front brake;

a bottom-front section of the chassis structure supporting a first integral independent suspension;

a bottom-middle section of the chassis structure supporting a second integral independent suspension and the front section of the second integral independent suspension is mounted in an opposite direction such that the second integral independent suspension operates in a forward motion and an opposing direction from the other independent suspension systems;

a central bottom section of the chassis structure supporting a third integral independent suspension and the front section of the third integral independent suspension is mounted in an opposite direction such that the third integral independent suspension operates in forward motion and an opposing direction from other independent suspension;

a middle-rear section of the chassis structure supporting a fourth integral independent suspension and the front section of the third integral suspension operates in forward motion and an opposing direction from the other independent suspension;

a rear section of the chassis structure supporting a fourth integral independent suspension and the front section of the fourth integral independent suspension are mounted in an opposite direction such that the fourth integral independent suspension operates in forward motion and opposite direction from the other independent suspensions;

the chassis structure interconnects and supports the removable boot, integral independent systems, and a central rolling-brake system with a plurality of removable fasteners;

(b) the integral independent suspension systems comprising;

a four wheeled configuration having forks pivotally mounted on axles such that the forks pivot in a forward motion and opposite directions from each other;

the integral independent suspension system mounted directly under the chassis structure and attached with plurality of removable fasteners;

the integral independent suspension systems supports a front and rear shock absorbers assemblies and rolling devices;

said front and rear shock absorber assemblies having a shock absorber main-shaft inside a shock absorber chamber assembly;

front shock absorber main-shaft supports a compression shock coils spring;

the front shock absorber main-shaft having a rear and side pivotally attached to a middle-shaft disposed around the main-shaft;

the front shock absorber main-shaft also having a front side engaged to a shock absorber piston;

the shock absorber piston having a front side attached to a shock coils spring adjuster knob;

the front shock chamber assembly contains hydraulic-fluid in a main reservoir, and a second double hydraulic-fluid parallel reservoir;

the front shock chamber assembly having a front section comprising a rubber brake impact control pad attached to a removable screw and a screw cover device;

the middle-shaft interconnects with the rear side of the front shock absorber main-shaft at once end the other end interconnects with a head central-trigger device, the middle-shaft interconnects to the rear of the main-shaft and to the front of the head central-trigger device through the pivot axles of the attached forks;

(d) the rear shock absorber assemblies having a rear shock absorber main-shaft inside a shock chamber assembly, and the rear shock absorber main-shaft supports around split torsional shock-coils springs between a central head-trigger, and rear shock absorber main-shaft supports a plurality of ball-bearings in and a plurality of collar-retainers support torsional coils springs and forks-base-cover device;

a rear shock absorber main-shaft supports fork pivot axles and ball bearings;

the fork pivot axles support forks and wheels;

(e) a removable boot with a supporting front and rear build-in anatomical-frame, in which the anatomical-frame supports the boot structure and the rear end of the boot structure supports and articulated boot ankle device;

(f) multiple brakes systems supported by the chassis structure;

the chassis structure supports a front brake device and a central rolling-brake system in which a central rolling-brake means includes rubberized ball-bearing shaft;

said front brake is mounted to the chassis structure front portion, such that the front brake is not related to the front integral independent suspension system, forks or wheels;

the front brake acts independently from the central rolling-brake system;

the central rolling-brake is mounted under the central longitudinal portion of the chassis;

at least two identical front central-brake systems are installed;

(g) a main rear brake assembly is supported by the rear integral independent suspension system, said main rear brake assembly including;

at least one pair of forks, connected to the front portion of the fourth integral independent suspension system through pivot axles;

a rubber device for engaging the rear wheel as the said in-line roller skate superimposes pressure down in a cross position to the lock the rear wheel of an opposite in-line-roller skate;

said pivot axles support a coil spring;

a plurality of rubber pads under a main rear-brake platform to slow the impact of the main rear-brake fork as it returns to the original position.

2. An in-line-roller skate as claimed in claim 1 in which the second double hydraulic-fluid parallel reservoir chamber supports at least two hydraulic-fluid said by-pass-valves.

3. An in-line-roller skate as claimed in claim 1 in which the chassis structure supports at least five symmetrical partitions longitudinally aligned under the boot platform.

4. An in-line-roller skate as claimed in claim 1 in which at least four collar retainers support the rear suspension torsional coils spring.

5. An in-line-roller skate as claimed in claim 1 in which rolling-devices support at least four wheeled pivotal axles and ball bearings devices.

6. An in-line-roller skate as claimed in claim 1 in which the independent suspension systems include forks means pivoting to an open position up to 140° about the fork pivot axles.

7. An in-line-roller skate as claimed in claim 1 in which said removable boot system having an anatomical-frame ankle support structure includes a plurality of braids and top buckle devices.

* * * * *